US011330391B2

(12) United States Patent
De Muynke et al.

(10) Patent No.: US 11,330,391 B2
(45) Date of Patent: May 10, 2022

(54) REVERBERATION TECHNIQUE FOR 3D AUDIO OBJECTS

(71) Applicant: FUNDACIÓ EURECAT, Cerdanyola del Vallès (ES)

(72) Inventors: Julien De Muynke, Barcelona (ES); Adan Amor Garriga Torres, Premia de Mar (ES); Andrés Pérez-López, Valencia (ES); Gerard Erruz López, Barcelona (ES); Timothy Schmele, Barcelona (ES); Umut Sayin, Barcelona (ES); Niklas Reppel, Barcelona (ES); Antonio Farran Masana, Barcelona (ES)

(73) Assignee: FUNDACIÓ EURECAT, Cerdanyola del Vallès (ES)

( * ) Notice: Subject to any disclaimer, the term of this patent is extended or adjusted under 35 U.S.C. 154(b) by 0 days.

(21) Appl. No.: 17/042,000

(22) PCT Filed: Mar. 27, 2019

(86) PCT No.: PCT/EP2019/057775

§ 371 (c)(1),
(2) Date: Sep. 25, 2020

(87) PCT Pub. No.: WO2019/185743

PCT Pub. Date: Oct. 3, 2019

(65) Prior Publication Data

US 2021/0029487 A1 Jan. 28, 2021

(30) Foreign Application Priority Data

Mar. 28, 2018 (EP) ..... EPl8382220

(51) Int. Cl.
*H04S 7/00* (2006.01)
*G10K 15/08* (2006.01)

(52) U.S. Cl.
CPC ..... *H04S 7/305* (2013.01); *G10K 15/08* (2013.01); *H04S 2400/11* (2013.01); *H04S 2400/15* (2013.01)

(58) Field of Classification Search
None
See application file for complete search history.

(56) References Cited

U.S. PATENT DOCUMENTS

2016/0100268 A1* 4/2016 Stein ..... H04R 5/00 381/17
2016/0255452 A1 9/2016 Nowak et al.
(Continued)

FOREIGN PATENT DOCUMENTS

CN 102665156 A 9/2012
EP 2809088 A1 3/2014
EP 2838084 A1 8/2015

OTHER PUBLICATIONS

International Search Report of the International Searching Authority. International Application No. PCT/EP2019/057775 issued by the European Patent Office, dated Jul. 5, 2019, 4 pages, Rijswijk, Netherlands.

(Continued)

*Primary Examiner* — Qin Zhu
(74) *Attorney, Agent, or Firm* — Peter B. Scull; EIP US LLP

(57) ABSTRACT

Reverberation techniques for 3D audio are disclosed. In an example method, a three-dimensional (3D) reverberation is applied to a sound object placed at a sound object position in a sound room. The sound object originates from a sound object position. A sound object signal is received. A 3D spatial room response (SRR) signal is computed corresponding to the user-selected position. A time convolution operation is performed between an audio signal of the sound (Continued)

object signal and the computed SRR value to generate a reverberated signal.

18 Claims, 3 Drawing Sheets

(56) References Cited

U.S. PATENT DOCUMENTS

| | | | | |
|---|---|---|---|---|
| 2017/0078820 | A1* | 3/2017 | Brandenburg | H04S 7/301 |
| 2017/0353789 | A1* | 12/2017 | Kim | H04R 3/005 |
| 2019/0215637 | A1* | 7/2019 | Lee | G10L 21/0208 |
| 2019/0246236 | A1* | 8/2019 | Ehara | G10L 19/008 |
| 2020/0186955 | A1* | 6/2020 | Yang | H04S 1/007 |
| 2020/0260209 | A1* | 8/2020 | Yadegari | H04S 7/305 |

OTHER PUBLICATIONS

Southern, Alexander et al., Spatial Room Impulse Responses with a Hybrid Modeling Method, Audio Engineering Society Convention 130th; Convention Paper 8385, May 13, 2011, pp. 1-14, Audio Engineering Society, New York, New York, USA.

Muhammad, Imran, et al., Immersive Audio Rendering for Interactive Complex Virtual Architectural Environments, Conference: 2016 Audio Engineering Society International Conference on Audio for Virtual and Augmented Reality; Sep. 2016, Audio Engineering Society, New York, New York, USA.

Mitsuo, Matsumoto et al., A method of interpolating binaural impulse responses for moving sound images, Acoustical Science and Technology, Jan. 1, 2003, pp. 284-292, vol. 24, No. 5, Acoustical Society of Japan, Tokyo, Japan.

Melchior, Frank, Investigations on spatial sound design based on measured room impulse responses, Thesis, Jun. 24, 2011, pp. 1-307, TU Delft, Netherlands.

Farina, Angelo et al., Measuring Spatial MIMO Impulse Responses in Rooms Employing Spherical Transducer Arrays, Conference: 2016 AES International Conference on Sound Field Control, Jul. 2016, pp. 1-10, Audio Engineering Society, New York, New York, USA.

Extended European Search Report for Application No. EP18382220.4 dated Jul. 12, 2018,10 pages, issued by the European Patent Office, Munich, Germany.

* cited by examiner

REVERBERATION TECHNIQUE FOR 3D AUDIO OBJECTS

The present disclosure is directed to the audio sector. Specifically, it refers to the processing of 3D audio and sound objects in the space of acoustic environments. The fields of application are: audiovisual productions, videogames, virtual reality and musical productions.

BACKGROUND

Spatial audio coding tools are well known and standardized, such as the standard MPEG-surround. The spatial audio coding starts from a multichannel input of the original source, for example having 5 or 7 channels. Each of the channels may feed a loudspeaker of a reproduction system. This is referred to as channel-based spatial audio. For example one channel may be sent to the left loudspeaker of the reproduction system, one to the central loudspeaker, one to the right loudspeaker, one to the left surround loudspeaker, one to the right surround loudspeaker and one to the subwoofer.

The spatial audio encoder may derive one or more down-mix channels (such as stereo correspondents) and, additionally, it may calculate parametric data such as inter-channel level differences, phase differences, time delays, etc. The down-mix channels together with the parametric information may be transmitted to a decoder to finally obtain the output channels that most closely approximate the original input. The location of the loudspeakers of the reproduction system may be defined by standards, as in the case of 5.1 or 7.1 surround sound format standards.

Tools for spatially encoding sound objects are also known. In contrast to channel-based spatial audio, the coding of objects starts from sound objects that are not automatically linked to a certain reproduction setup. The positioning of sound objects in the reproduction is flexible and can be modified by the user through certain rendering information transmitted to the decoder. Additionally, the rendering information may include some position information that varies over time so that the audio object can follow a trajectory over time.

To obtain some data compression, the sound objects may be encoded using a spatial encoder that calculates, from the initial objects, one or more channels of the down mixing process. In addition, the encoder may calculate parametric information representing characteristics such as the difference in level between objects, the difference in acoustic coherence, etc. This parametric data may be calculated for individual space/frequency windows, which means that the parametric data may be obtained for each frame (every 1024 or 2048 samples for example) and for each frequency band (24, 32 or 24 bands in total). For example, when an audio piece has 20 frames and it is subdivided into 32 frequency bands, the number of windows is 640.

SUMMARY

In 3D audio systems it may be desirable to provide the spatial impression as if the audio signal were heard in a particular room (a landmark building such as a theater or a specific opera). In this situation, an impulse response from the room must be provided based, for example, on in situ measurements. This response function must be used to process the audio before it is rendered. The first reflections and the reverberant tail of the impulse response function are usually processed separately.

An aspect hereof may include provision of an approximation to the processing of the spatial impulse response functions to genuinely obtain a spatial reverberation from measurements or simulations of the so-called SRRs (Spatial Room Responses) that contain directional characteristics, and the separate treatment of the first reflections and the reverberant tail.

Methods for improving the processing of room spatial responses (SRRs) for sound objects are presented. In the following, the term "sound object" will refer to audio signals and the associated metadata that may have been created without reference to a certain playback system. The associated metadata can include the position data of the sound object, sound level data (gains), font size, trajectory, etc. The term "rendering" refers to the process of transforming the sound objects into power signals for the speakers in some particular reproduction system. The rendering process can be carried out, at least in part, according to the associated metadata, the reproduction system or metadata coming from the user. The reproduction system data may include an indication of the number of loudspeakers and the location data of each of the loudspeakers. The user data may include the position at each instant of time of the user within the reproduction space as well as the orientation of his head.

In a first aspect, a method of applying a three-dimensional reverberation to a sound object at a sound object position in a sound room, the sound object originating from a sound object position is proposed. The method may include receiving a signal from the sound object; computing a spatial room response (SRR) signal corresponding to the sound object position; and performing a time convolution operation between the signal from the sound object and the computed SRR signal to calculate a reverberated signal.

The method is based on the processing of each sound object with an SRR network in order to incorporate the acoustics of an acoustic environment given to the sound object while preserving the location in space. The proposed method processes audio according to the spatial responses of a room, SRRs (Spatial Room Responses), their subsequent coding and sending to a processing unit, a binaural renderer, and ultimately at an encoder and decoder of audio.

In some examples, computing an SRR signal corresponding to the sound object position may include interpolating existing SRR signals. The existing SRR signals may be stored in a database and may be retrieved from the database based on metadata associated with the user position. For example, the sound object position may be in the form of coordinates and the existing SRR signals may be stored along with coordinates corresponding to the position they were captured. Such coordinates may correspond to sampled positions in the room. Existing (stored) SRR signals that correspond to positions closer to the selected position may be selected for the interpolation.

In some examples, the existing SRR signals may be measured by a 3D microphone at distinct distances from the sound object position. Thus a network of SRR signals may be generated. The network of SRRs corresponding to the acoustic environment that is desired to be reproduced may be measured by specialized microphones or intensimetric probes, in the case of real environments, or by simulations, both for real and virtual environments. The network of SRRs may include a set of spatial response functions distributed in the acoustic environment to be reproduced. This set of functions may be calculated in a Euclidean network or may be distributed in the space according to other geometries. In some examples the existing SRR signals are measured on coaxial cylinder positions. The proposed method contemplates any value for the amount of SRR signals although at higher density better final acoustic perception will be obtained.

The proposed method is based on the processing of each sound object together with a function derived from the set of SRRs corresponding to the spatial location of said sound object.

As an example, this function can be obtained following the method referred to as Vector Based Amplitude Panning, which allows panning a source to any position that belongs to the surface of a triangle defined by three loudspeakers. It may include calculating the appropriate gains for each loudspeaker's signal so that the sound source appears to be in the desired location, given the exact location of these 3 loudspeakers. This can be seen as a linear combination of the same signal played by 3 loudspeakers close to each other.

Similarly, the SRR corresponding to the desired location may be calculated as a linear combination of the 3 neighboring SRRs that have been previously recorded, given their position in space. Since the entire area spanned by the SRR measurements can be divided into individual non-overlapping triangles, the SRRs combination previously described may be achieved on the whole area spanned by the SRRs measurements by selecting the triangle where the desired location belongs. The SRRs can then be calculated for any position belonging to the surface of any triangle formed of 3 measured SRRs.

In case some SRRs have been measured at different distances from the listening position, i.e. the microphone position, this method can be easily extended to the volume of a tetrahedron formed by 4 SRRs measured at different distances. Considering that the entire volume spanned by the SRRs measured at different distances can be divided into individual non-overlapping tetrahedrons, this method allows calculating the SRR corresponding to any position belonging to the entire volume spanned by the whole set of measured SRRs. This is sometimes called "tetrahedral interpolation".

Once calculated, the function derived from the SRRs may be processed with the corresponding sound object. This processing may be divided into two parts: one corresponding to the first part of the function that contains the first reflections; and a second part of the function that incorporates the reverberant tail.

In some examples, interpolating existing SRR values may include performing a bi-triangular interpolation between existing SRR values. Performing a bi-triangular interpolation may include identifying three measurement points on a surface of two neighboring coaxial cylinders, the three measurement points being the closest to the sound object position; performing a triangulation on both neighboring coaxial cylinder surfaces.

In some examples, performing a triangulation on a cylinder surface may include combining corresponding SRR signals at the identified points with weights depending on the actual distance between the SRR measurement position and the sound object position.

In some examples, the SRR signals may be room-impulse-response (RIR) signals in three dimensions.

In another aspect, a device to apply a three-dimensional reverberation to a sound object at a sound object position in a sound room, the sound object originating from a sound object position, is provided. The device may include a receiver to receive a signal from the sound object; an SRR logic to compute a spatial room response (SRR) signal corresponding to the sound object position; a signal convolution logic (reverberation processor) to perform a time convolution operation between the signal from the sound object and the computed SRR signal.

In some examples, the reverberation processor may be configured to perform the time convolution operation between the sound object and the computed 3D SRR signal as the sound object changes position, i.e. moves, in the sound room. Different SRR signals may be computed at different positions resulting, each time, in different convolution operations and interpolations. The time convolution operation may be performed in a continuous manner, as the sound object moves, or at discrete sampled positions.

In some examples, the device may be connectable to a database storing existing SRR signals. The SRR logic may be configured to identify and retrieve existing SRR signals in the database associated with the sound object position.

The methods mentioned herein can be implemented via hardware, firmware, software and/or combinations thereof. For example, some aspects hereof may be implemented in an apparatus that includes an interface system and a logic system. The interface system may include a user interface and/or a network interface. In some implementations, the apparatus may include a memory system. The interface system may include at least one interface between the logical system and the memory system.

The logic system may include at least one processor, such as a processor with one or multiple chips, a digital signal processor (DSP), a specific integrated circuit (ASIC), a programmable gate array (FPGA), or other programmable logic devices, discrete doors or logical transistors, discrete hardware components and/or combinations of these.

In some implementations, the logical system may be able to receive, via the interface system, audio data from sound objects. Sound objects can include audio signals and associated metadata. In some implementations, the associated metadata will include the position, the velocity of the object and the acoustic environment of the sound object. Based on this information, the logical system will be able to associate the object with the appropriate set of SRRs and calculate the reverberated signal.

The associated process may be independent of the particular speaker configuration of the reproduction system. For example, the associated process may involve the rendering of the resulting sound objects according to the virtual speaker locations. The logical system may be able to receive, via the interface system, metadata corresponding to the location and acoustic characteristics of the sound object. Reverb processing can be performed, in part, according to this metadata.

The logical system may be able to encode the output data from the associated process. In some implementations, the coding process may not involve encoding the metadata used.

At least some of the locations of the objects can be stationary. However, some of the locations of the objects may vary over time.

The logical system may be able to calculate contributions from virtual sources. The logical system may be able to determine a set of gains for each of the plurality of output channels based, in part, on the contributions of the calculations.

The logical system may be able to evaluate the audio data to determine the type of content.

Details of one or more implementations of this specification are presented, accompanied by schemes, below. Other features, details, and advantages will be evident from the descriptions, schemes and claims.

In another aspect, a computer program product is disclosed. The computer program product may include program instructions for causing a computing system to perform a method of applying a three-dimensional reverberation to a sound object at a sound object position in a sound room according to some examples disclosed herein.

The computer program product may be embodied on a storage medium (for example, a CD-ROM, a DVD, a USB drive, on a computer memory or on a read-only memory) or carried on a carrier signal (for example, on an electrical or optical carrier signal).

The computer program may be in the form of source code, object code, a code intermediate source and object code such as in partially compiled form, or in any other form suitable for use in the implementation of the processes. The carrier may be any entity or device capable of carrying the computer program.

For example, the carrier may include a storage medium, such as a ROM, for example a CD ROM or a semiconductor ROM, or a magnetic recording medium, for example a hard disk. Further, the carrier may be a transmissible carrier such as an electrical or optical signal, which may be conveyed via electrical or optical cable or by radio or other devices, systems and/or methods.

When the computer program is embodied in a signal that may be conveyed directly by a cable or other device or devices or systems and/or methods, the carrier may be constituted by such cable or other device or devices or systems or methods.

Alternatively, the carrier may be an integrated circuit in which the computer program is embedded, the integrated circuit being adapted for performing, or for use in the performance of, the relevant methods.

BRIEF DESCRIPTION OF THE DRAWINGS

Non-limiting examples of the present disclosure will be described in the following, with reference to the appended drawings, in which.

DETAILED DESCRIPTION OF EXAMPLES

It is noted that the project leading to this application has received funding from the European Union's Horizon 2020 research and innovation programme under grant agreement No 732130".

Depending on the nature and origin of the SRRs available in the SRRs database, a user is allowed to simulate the acoustics of some particular rooms, by adding the corresponding 3D reverberations of these rooms to some audio objects of his choice.

A set of SRRs of a particular room may be composed of or include several 3D RIRs (meaning RIRs with directional cues) measured from different points of space around a listening position, yielding a 'cartography' in 3D of the acoustics of the room as perceived at the listening position.

Figure 1:
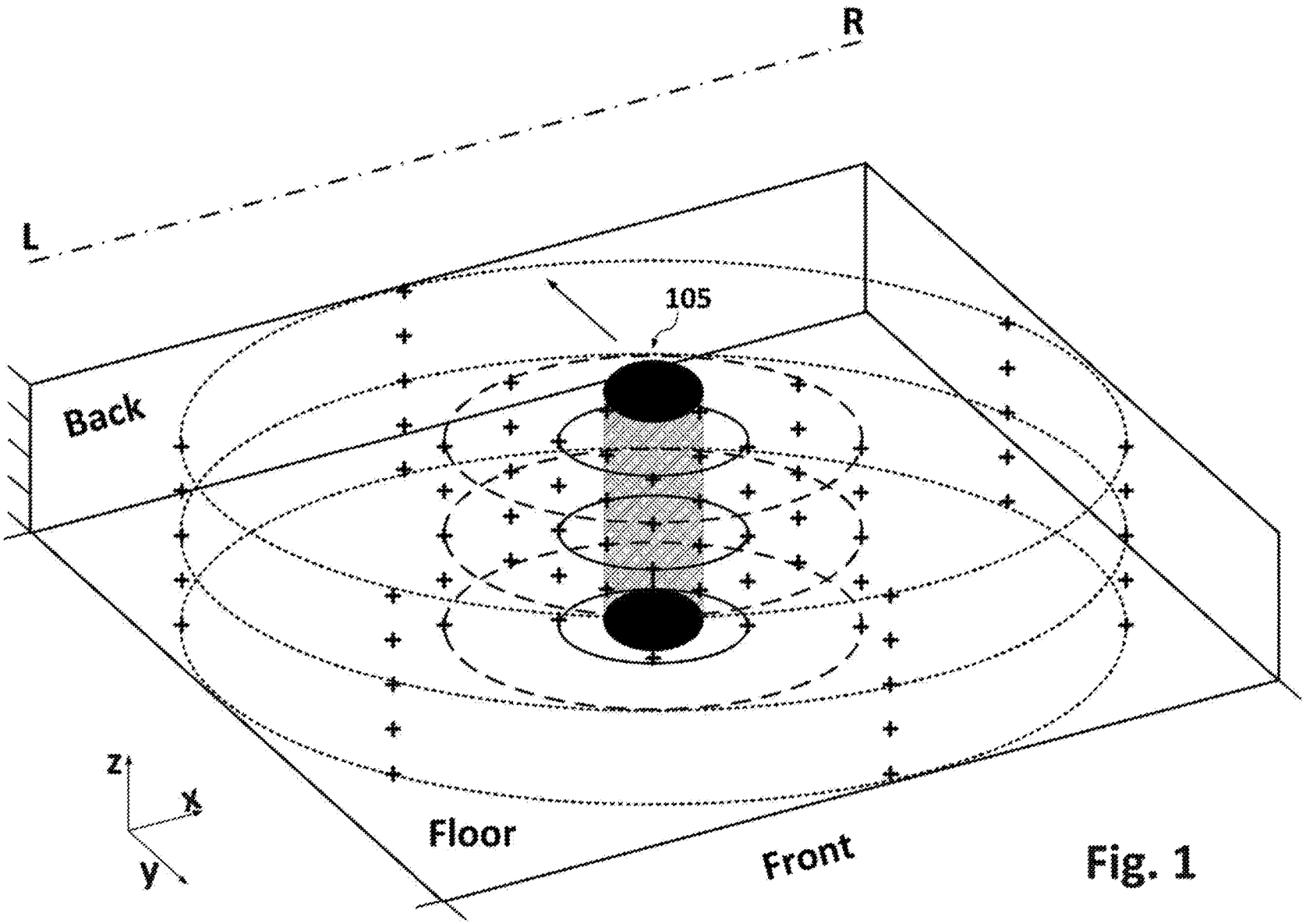
FIG. 1 schematically illustrates a measurement grid in a sound room (auditorium)

FIG. 1 schematically illustrates a measurement grid in a sound room.

Distribution of the Measurement Points

The listening position is set at a location 105 where the conductor usually stands, pointing towards the back B of the stage. It is then located on the edge of the stage (meaning that the orchestra stands in front while the audience stands in the back), centered on the left-right axis (L-R), at a height of 2 meters above the stage's floor F. The distribution of the measurement positions (indicated by cross symbols in FIG. 1) is cylindrical: they all belong to the surface of some cylinders of different radii (=different distances from the listening position), whose revolution's axis is vertical and passes by the listening position, at different height. Concretely, in an example implementation for the Auditorium of Barcelona:

the distances are: 1 m, 2 m, 5 m, 10 m the azimuth are: 0°, 45°, 90°, 135°, 180°, 225°, 270°, 315° the heights are: −2 m (on the stage's floor), −1 m, 0 m, 1 m, 2 m

Consequently, the SRRs database of the Auditorium of Barcelona is composed of 4×8×5=160 SRRs measurements, constituting a cartography in 3D of the acoustics of this room as perceived from the conductor's location.

As the aim of the described technique is to add the reverberation of particular acoustic spaces to a number of audio objects, the SRRs contain the reverberation of the measured spaces. The reverberation time of a room (duration of the set of subsequent echoes generated by an impulsive sound emitted in the room) depends on its geometry and absorbing properties, so the length of the SRRs varies as a function of the room considered.

In the example of the Auditorium of Barcelona, with the reverberation time being of 1.5 seconds, the SRRs have 72000 samples with a sampling frequency of 48 kHz. Moreover, the SRRs are RIRs in 3D, meaning that some directional cues may be added to the standard RIRs. In the present example, SRRs may be captured by a 3D microphone that features 4 capsules spread along the surface of a rigid sphere. As a result, each SRR may be composed of or include 4 signals of length 72000 samples. The audio samples may be stored in WAV 24-bits format.

Thanks to the set of SRRs described previously, the present technique allows for generating the reverberation pattern in 3D of an audio source placed in any position in between the measurement points, as it would be perceived from the conductor's location. In consequence, the user may be able to position any of his sound objects in the sound room within the limits of the volume covered by the measurement points distribution.

Via the user interface, the user may choose to place a specific sound object (=audio signal) in a specific position of the Auditorium of Barcelona: e.g. distance of 3 m, azimuth of 30°, height of 1.2 m.

The sound object (=audio signal material) may then be aggregated with the following metadata:

room name (e.g. Auditorium of Barcelona)

coordinates system: cylindrical position (e.g. 3 meters distance, 30° azimuth, 1.2 meters height)

The 'room' data allows the system to select the set of SRRs corresponding to the Auditorium of Barcelona from the SRRs database. The 'coordinates system' and 'position' data allow picking up the subset of adequate SRRs from the set of SRRs of the Auditorium of Barcelona.

Figure 2:
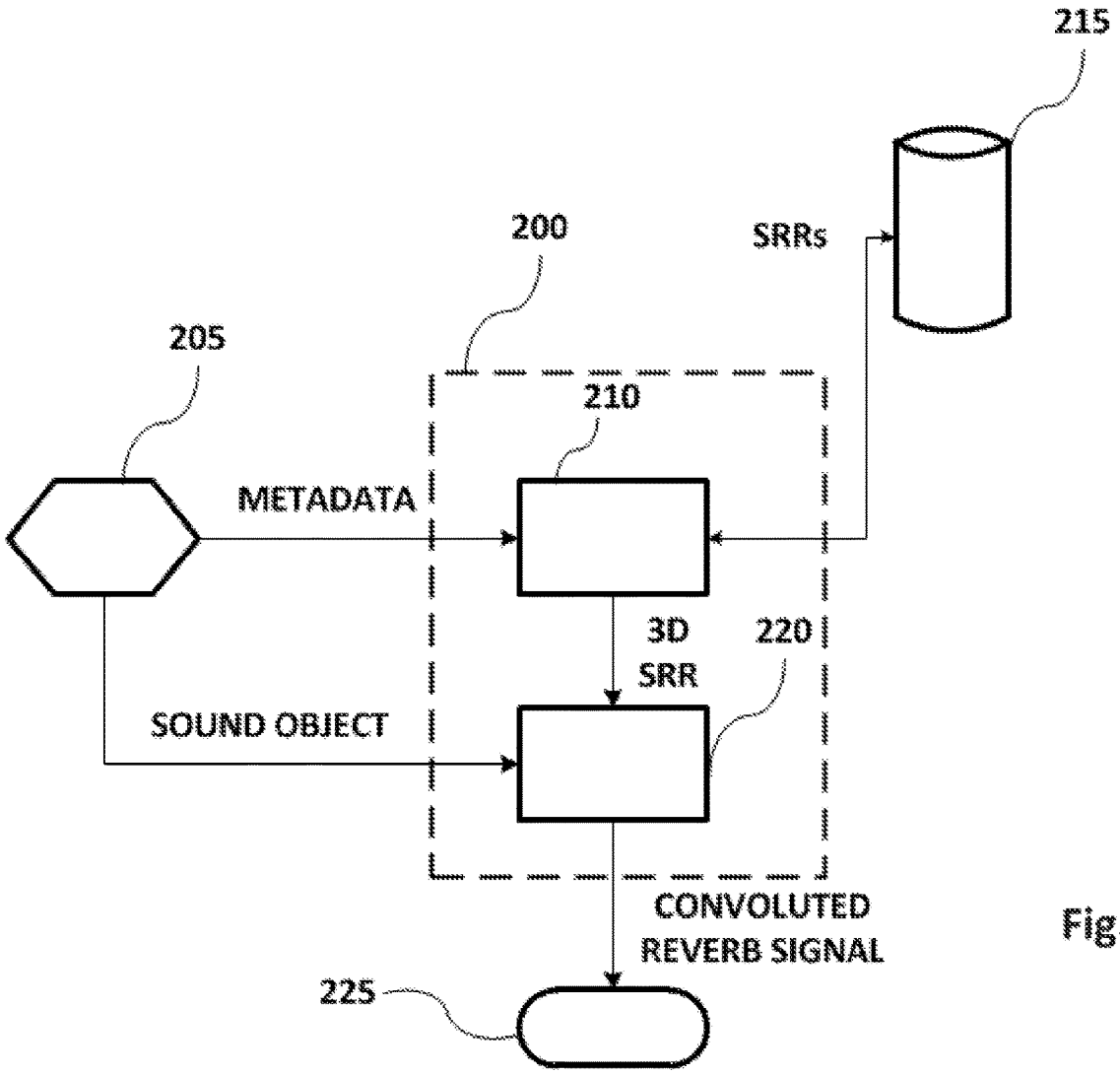
FIG. 2 is a block diagram of a device to apply a three-dimensional reverberation to a sound object at a sound object position in a sound room, according to an example.

FIG. 2 is a block diagram of a system to apply a three-dimensional reverberation to a sound object at a sound object position in a sound room, according to an example. A sound object 205 may be positioned in a sound room within a space already covered by a measurement grid as in FIG. 1. The sound object 205 may include an audio signal and metadata related to the sound room and/or the sound object.

The metadata may be sent to a first logic unit 210 (or SRR logic 210) of device 200. The metadata may include, among other information, the room name, the coordinate system and the position of the sound object in the room. The first logic unit 210 may receive the metadata and select SRRs from SRR database 215. SRR database 215 may include SRR measurements of the sound room. The SRR database 215 may form part of the device 200 or may be external and the device 200 may connect to or communicate with the SRR database 215 to retrieve the relevant SRRs. The first logic 210 may thus select the SRR measurements that correspond to positions that are closer to the position of the sound object 205 in the sound room.

Computing the SRR corresponding to the chosen position may include processing the SRRs data of the subset of SRRs extracted in the previous step. This can be seen as an interpolation process, which is achieved by the first logic unit 210.

In the present example, the interpolation method is bi-triangular: over the surface of two neighboring cylinders, the system looks for the 3 measurement points closest to the chosen position so as to achieves a triangulation on both cylinder's surfaces. Next, it achieves a linear interpolation between the two SRRs computed by each triangulation process.

In an example, the selected position is at 3 meters distance, 30° azimuth, 1.2 meters height and the SRRs extracted from the set of SRRs of the Auditorium of Barcelona are the following:

(2 m distance, 0° azimuth, 1 m height)
(2 m distance, 45° azimuth, 1 m height)
(2 m distance, 45° azimuth, 2 m height)

to achieve the triangulation over the surface of the cylinder of radius 2 m, and:

(5 m distance, 0° azimuth, 1 m height)
(5 m distance, 45° azimuth, 1 m height)
(5 m distance, 45° azimuth, 2 m height)

to achieve the triangulation over the surface of the cylinder of radius 5 m.

Each triangulation process may include combining the 3 corresponding SRRs signals with weights depending on the actual distance between the SRR measurement position and the position chosen by the user.

Moreover, since the SRRs are RIRs in 3D, the SRR computed by the triangulation process has a 3D orientation which is different from the 3D orientation of any of the 3 actually measured SRRs. Consequently, in addition to combining the 3 actually measured SRRs, the triangulation process also achieves a mixing of the 4 different channels of the SRRs so as to modify the 3D orientation.

The audio signal of the sound object 205 may be emitted to second logic unit 220. The second logic unit 220 (or reverberation processor 220) may receive the audio signal of the sound object 205 and the selected SRRs from the first logic unit 210 and perform a convolution operation to apply the 3D reverberation to the sound object.

Applying the 3D reverberation to the audio signal of the sound object is done by the second logic unit 220, through a time convolution operation between the audio signal of the sound object and the different channels of the SRR issued from the previous step. This leads to a 3D reverberated sound object composed of or including 4 channels, which is later on decoded by the reproduction system 225. The end listener will then perceive the sound object as if it had been originally recorded in the chosen position (3 meters distance, 30° azimuth, 1.2 meters height, from the conductor's usual location) of the sound room, e.g. the Auditorium of Barcelona.

Figure 3:
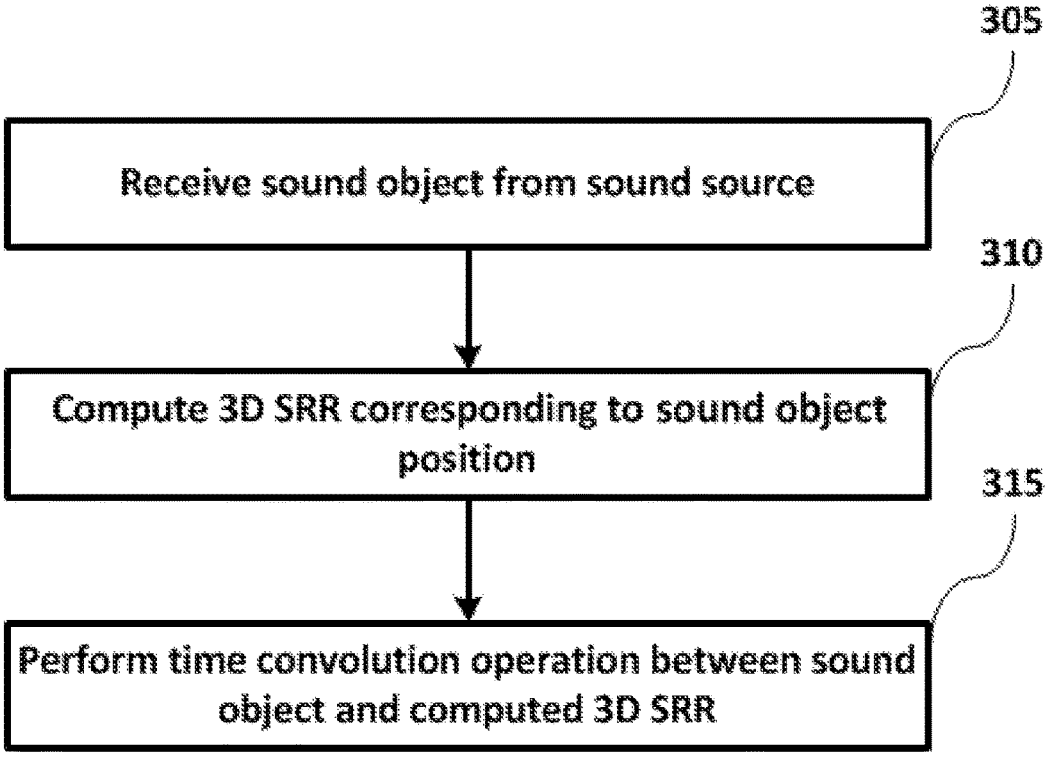
FIG. 3 is a flow diagram of a method of applying a three-dimensional reverberation to a sound object at a sound object position in a sound room, according to an example.

FIG. 3 is a flow diagram of a method of applying a three-dimensional reverberation to a sound object at a sound object position in a sound room, according to an example. In block 305, a sound object is received from a sound source. Then, in block 310, a 3D SRR signal corresponding to the user-selected position may be computed. In block 315, a time convolution operation may be performed between an audio signal of the sound object and the computed 3D SRR.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow. If reference signs related to drawings are placed in parentheses in a claim, they are solely for attempting to increase the intelligibility of the claim, and shall not be construed as limiting the scope of the claim.

Further, although the examples described with reference to the drawings may include computing apparatus/systems and processes performed in computing apparatus/systems, the developments hereof also extend to computer programs, including computer programs on or in a carrier, adapted for putting the system into practice.

The invention claimed is:

1. Method of applying a three-dimensional (3D) reverberation to a sound object as perceived from a listening position in a sound room, the sound object originating from a sound object position, the method comprising:

receiving a sound object signal;

computing a 3D spatial room response (SRR) signal corresponding to the sound object position, the computing a 3D SRR signal corresponding to the sound object position comprising:

interpolating existing SRR signals stored in a database, the interpolating existing SRR values comprising performing a bi-triangular or tetrahedral interpolation between existing SRR values, and, selecting the existing SRR signals based on metadata of the sound object signal;

performing a time convolution operation between an audio signal of the sound object signal and the computed SRR value to calculate a reverberated signal.

2. The method according to claim 1, further including:

measuring the existing SRR signals by a 3D microphone at distinct distances from the sound source position.

3. The method according to claim 2, further including:

measuring the existing SRR signals on positions of a coordinate system.

4. The method according to claim 3 the coordinate system being one of a cylindrical, a Cartesian or a spherical coordinate system.

5. The method according to claim 1, the performing a bi-triangular interpolation comprising:

identifying three measurement points on a surface of two neighboring coaxial cylinders, the three measurement points being the closest to the sound object position;

performing a triangulation on both neighboring coaxial cylinder surfaces.

6. The method according to claim 5, the performing a triangulation on a cylinder surface comprising combining corresponding SRR signals at the identified points with weights depending on actual distance between SRR measurement position and the sound object position.

7. The method according to claim 1, the performing a tetrahedral interpolation comprising:

identifying four measurement points belonging to a surface of two different neighboring coaxial cylinders, the four measurement points being the closest to the sound object position;

performing a triangulation on a volume defined by the four measurement points.

8. The method according to claim 7, the performing a triangulation in a tetrahedron comprising combining corresponding SRR signals at the identified points with weights depending on an actual distance between SRR measurement position and the sound object position.

9. The method according to claim 1, the SRR signals being room-impulse-response (RIR) signals in three dimensions.

10. A device to apply a three-dimensional reverberation to a sound object at a sound object position in a sound room, the sound object originating from a sound object position, the device comprising:

a receiver to receive the sound object from the sound object position;

an SRR logic to compute a 3D spatial room response (SRR) signal corresponding to the sound object position, the SRR logic being configured to interpolate existing SRR signals stored in a database, the SSR logic being further configured to select the existing SRR signals based on metadata of the sound object signal the SSR logic being further configured to interpolate existing SRR signals by performing a bi-triangular or tetrahedral interpolation between existing SRR signals;

a reverberation processor to perform a time convolution operation between the sound object and the computed 3D SRR signal.

11. A device according to claim 10, the reverberation processor being configured to perform the time convolution operation between the sound object and the computed 3D SRR signal as the sound object changes position in the sound room.

12. The device according to claim 10, connectable to a database storing existing SRR signals, the SRR logic being configured to identify and retrieve existing SRR signals in the database associated with the sound object position.

13. A computer program product comprising program instructions embodied on a non-transitory medium for causing a computing system to perform a method according to claim 1.

14. A computer program product according to claim 13, embodied on a non-transitory storage medium.

15. Method of applying a three-dimensional (3D) reverberation to a sound object as perceived from a listening position in a sound room, the listening position corresponding to a microphone position at which 3D spatial room responses (SRR) are measured, the sound object originating from a sound object position, the method comprising:

receiving a sound object, the sound object comprising an audio signal and associated metadata, the associated metadata comprising the sound object position;

computing a 3D spatial room response (SRR) corresponding to the sound object position, the computing a SRR corresponding to the sound object position comprising:

selecting existing SRRs to be interpolated based on the sound object position, storing the existing SRRs in a database together with coordinates corresponding to their capture position, and interpolating the selected existing SRRs stored in the database, the interpolating existing SRR values comprising performing a bi-triangular or tetrahedral interpolation between existing SRR values;

performing a time convolution operation between the audio signal of the sound object and the computed SRR value to calculate a reverberated signal.

16. The method according claim 15, further comprising:

measuring the existing SRRs by a 3D microphone at distinct distances from the sound source position.

17. The method according to claim 16, further comprising measuring the existing SRR signals on positions of a coordinate system.

18. The method according to claim 17, the coordinate system being one of a cylindrical, a Cartesian or a spherical coordinate system.

* * * * *